US008573692B2

(12) United States Patent
Nazginov

(10) Patent No.: US 8,573,692 B2
(45) Date of Patent: Nov. 5, 2013

(54) SLIPCOVERS WITH IMPROVED MATERIAL GATHERING

(76) Inventor: Arthur Nazginov, Woodside, NY (US)

( * ) Notice: Subject to any disclaimer, the term of this patent is extended or adjusted under 35 U.S.C. 154(b) by 1398 days.

(21) Appl. No.: 11/559,337

(22) Filed: Nov. 13, 2006

(65) Prior Publication Data

US 2007/0200403 A1 Aug. 30, 2007

Related U.S. Application Data

(60) Provisional application No. 60/735,743, filed on Nov. 11, 2005.

(51) Int. Cl.
*A47C 31/10* (2006.01)

(52) U.S. Cl.
USPC ..... 297/225; 297/228

(58) Field of Classification Search
USPC ..... 297/218.4, 225, 228, 228.11, 229; D6/611
See application file for complete search history.

(56) References Cited

U.S. PATENT DOCUMENTS 4,838,610 A 6/1989 Perrin
5,733,002 A * 3/1998 Riley et al. ..... 297/224
6,116,685 A * 9/2000 White et al. ..... 297/218.1
6,398,301 B1 * 6/2002 Illulian ..... 297/228
D473,089 S * 4/2003 Trucchi ..... D6/611
6,709,054 B2 * 3/2004 Riley et al. ..... 297/228
6,827,398 B2 12/2004 Nazginov
6,832,812 B2 * 12/2004 Riley et al. ..... 297/228
2004/0155497 A1 * 8/2004 Riley et al. ..... 297/225
2006/0071520 A1 * 4/2006 Miller ..... 297/225
2006/0103197 A1 * 5/2006 Baines ..... 297/229

OTHER PUBLICATIONS

International Search Report and Written Opinion dated Sep. 14, 2007 issued in corresponding PCT Application No. PCT/US2006/44004.

* cited by examiner

*Primary Examiner* — David Dunn
(74) *Attorney, Agent, or Firm* — Ostrolenk Faber LLP

(57) ABSTRACT

A furniture slipcover including a slipcover body and at least one band, such as a textile band, is provided. The slipcover body covers at least some surfaces of a piece of furniture, and a first end of the band is fixedly attached to the slipcover body, and the band extends in a horizontal direction when holding the bunched portion of the slipcover body. A fastening member, such as a clip, is disposed at a second end of each band. Also, each band may be provided as an elastic material that exerts a contracting force when the fastening member is secured to the bunched portion of the slipcover body. The band may be located on a portion of the slipcover that covers or is near to lateral edges of armrests and the backrest.

12 Claims, 5 Drawing Sheets

SLIPCOVERS WITH IMPROVED MATERIAL GATHERING

CROSS-REFERENCE TO RELATED APPLICATIONS

The present application claims priority from U.S. Provisional Patent Application No. 60/735,743, filed on Nov. 11, 2005, herein incorporated in full by reference.

BACKGROUND OF THE INVENTION

Furniture slipcovers are a cost-effective and useful way to change or improve the appearance of a sofa, chair, davenport or the like. Current slipcovers, such as those described in U.S. patent application Ser. No. 10/964,436, include a set of ties, or, alternatively, elastic strips, that are placed at predetermined locations on the slipcover that are easy to use and apply to upholstered furniture. The ties provide tension to secure the slipcover to the furniture. By providing a one-piece slipcover with ties (or some form of elasticity) a variety of differently sized and shaped furniture, such as chairs and sofas, can be covered with tension applied at the corners of the furniture.

Referring to the drawing figures in which like reference numerals refer to like elements, FIG. 1A illustrates a prior art slipcover 100 that includes fastening ties at predetermined positions, and placed on sofa 104*a*. In the prior art slipcover 100, eight fastening ties are provided, wherein two fastening ties form a set 102. Ties 102 are placed on slipcover 100 such that the fastening ties are tied at four corners of the sofa 104*a*. Fastening ties 102 are preferably positioned at the four corners of a sofa, for example, to maintain the slipcover 100 in place. Upon mounting the slipcover onto a piece of furniture, ties 102 allow the slipcover to be tightened to hug the furniture to remove any pleating or shirring appearance of the slipcover 100.

The prior art slipcover 100 shown in FIG. 1A is made of fabric of a size that enables it to cover the piece of upholstered furniture to be protected thereby. The slipcover 100 has a continuous integral peripheral bottom portion that defines a single opening into a tub-shaped cover that is designed to allow the slipcover to be lowered onto the sofa 104*a*, there being provided special pockets for the armrests 106 and the backrest 110 of the sofa. Although not shown in FIG. 1A, U.S. Pat. No. 4,838,610 describes that the slipcover 100 can be provided along the bottom thereof with a drawstring to gather excess material and to cleat and hold it at the selected length needed to tighten the bottom portion of the slipcover against the base of the furniture.

A conventional slipcover is designed to fit a range of sofa slot sizes, for example, from 60 to 90 inches. In the example shown in FIG. 1A, sofa 104*a*, has a seat width of 60 inches and a circumference of 200 inches. Fastening ties 102 may be tied in the form of a knot or bow, and are shown placed in various positions on sofa 104*a*. In the example prior art slipcover 100 shown in FIG. 1A, two fastening ties 102*a* and 102*b* are each positioned in the center the armrests 106 of sofa 104*a*, and two fastening ties 102*c* and 102*d* are each positioned near the corners 108 of the backrest 110 of sofa 104*a*. Positioning the fastening ties 102 in this way enables tension at all four corners of sofa 104*a*. Furthermore, the slipcover 100 fits on sofa 104*a*, and the fastening ties 102 are placed in their respective positions.

FIG. 1B illustrates the prior art slipcover 100 tied on a sofa 104*b*, which is larger in overall size than the sofa 104*a* shown in FIG. 1A, and has a seat width of 90 inches and circumference of 260 inches. As shown in FIG. 1B, when the slipcover

100 is placed on sofa 104*b*, the fastening ties 102 (102*a*-102*d*) are not in the respective positions shown in FIG. 1A. Since the seat of sofa 104*b* is wider by 30 inches, fastening ties 102*a* and 102*b*, in particular, are shifted closer to the center of sofa 104*b*, each by approximately 15 inches. Moreover, fastening ties 102*c* and 102*d* may also shift relative to the furniture covered and relative to the held bunched portion of the slipcover, particularly during longer periods of ordinary use or during particularly active periods. This results in an unseemly and undesirable appearance. FIG. 1C shows an example slipcover 100 when used on another piece of furniture (chair 112) which is smaller than sofa 104*a* (FIG. 1A). In the example shown in FIG. 1C, the respective positions of fastening ties 102*a* (FIG. 1C) are shifted away from the center of arms 106 because the size of slipcover 100 is inappropriate with respect to the size of chair 112. FIGS. 1D and 1E show, respectively, sets of the fastening ties 102 in the untied and tied positions.

It is recognized by the inventor that prior art slipcovers 100 present undesirable effects when placed over furniture which is not sized precisely to fit within the slipcover 100. Conventional slipcovers 100 may not appear uniform, streamlined and neat while placed over a single-sized piece of furniture.

The need exists therefore for a slipcover that fits variously sized furniture, including sofas and chairs, that maintains a neat, tight and fitted appearance. Also the need exists for a way to provide a snugger fit while minimizing the visibility of the securing means, or for providing a streamlined look therefor.

SUMMARY OF THE INVENTION

A furniture slipcover including a slipcover body and one or more bands, such as textile bands, is provided. The slipcover body is adapted to cover at least some surfaces of a piece of furniture, and a first end of each of the bands is fixedly attached to the slipcover. A fastening member is disposed at a second end of each band. The fastening member may include a clip, such as a suspender clip, a button or a velcro strip or other type of fastener operative to removably secure the cinching band directly to a bunched portion of the slipcover to provide a fitted appearance.

Also, each band may be provided as an elastic cinching material that exerts a contracting force when the fastening member is secured to the bunched portion of the slipcover body.

The first end of a first band may be located on a first portion of the slipcover adapted to cover an armrest of the piece of furniture, for example, at a lateral edge of the armrest. The first end of a second band may be located on a second portion of the slipcover adapted to cover a backrest of the piece of furniture, for example, at a lateral edge of the backrest.

The first end of a first band may be located on a first portion of the slipcover adapted to cover an armrest of the piece of furniture, the first end of a third band may be located on a third portion of the slipcover adapted to cover a second armrest of the piece of furniture, and the first end of a fourth band may be located on a fourth portion of the slipcover adapted to cover the backrest, such that the first and third portions are disposed to be located at lateral edges of the respective armrests, and the second and fourth portions are disposed to be located at opposite lateral edges of the backrest.

The first end of each band may be disposed to be closer to a lateral edge of the piece of furniture than the fastening member when the fastening member is secured to the bunched portion of the slipcover.

Moreover, each band may be provided as a loop starting at the first end of the band and threaded through the fastening member.

Further, each band may include a concealing member made of textile material adapted to conceal the fastening member.

Thus, according to an aspect of the present invention, a suspender clip or belt clip as known to those skilled in the art, is attached to a cinching band. The fastening member preferably attaches to the fabric of the slipcover and provides tension for a snug and neat appearance. By using fastening members attached to cinching bands, variously sized furniture maintains a uniform and neat appearance, and shifting of cinching bands placed in the front of the furniture may be prevented.

BRIEF DESCRIPTION OF THE DRAWINGS

For the purposes of illustrating the invention, there is shown in the drawings a form which is presently preferred, it being understood, however, that the invention is not limited to the precise arrangements and instrumentalities shown. The features and advantages of the present invention will become apparent from the following description of the invention that refers to the accompanying drawings, in which.

DETAILED DESCRIPTION OF EMBODIMENTS OF THE INVENTION

The present invention is an improved slipcover over prior art forms, and ensures a neat and uniform fit over various-sized furniture, such as a sofa, loveseat, davenport, chair or the like.

As noted above, prior art slipcovers 100 comprise eight individual ties that provide four sets of two ties. Each pair of ties 102 is preferably positioned at a respective one of the four corners of a sofa, to maintain the slipcover in place and maintain a fitted, tight appearance. In place of four sets of 2 ties 102, the present invention includes four individual cinching bands that are each provided with a fastening member that is attached to one end of each cinching band made of a stretchable or stretchable material. The other end of the cinching band is preferably fixed (e.g., sewn) to the slipcover. In a preferred embodiment, the fastening member is a clip-on device, such as a suspender clip or belt clip. In alternative embodiments, fastening member can include a section of VELCRO, a button, or any other known fastening means. However, it will be understood that fewer than four or more than four cinching bands may also be provided without departing from the spirit of the present invention.

The invention permits providing the slipcovers in as few as three sizes, for example, small, medium and large, so as to fit most couches that are typically available in the marketplace. But more sizes can be provided, for example, four or five or even more.

Figure 1A:
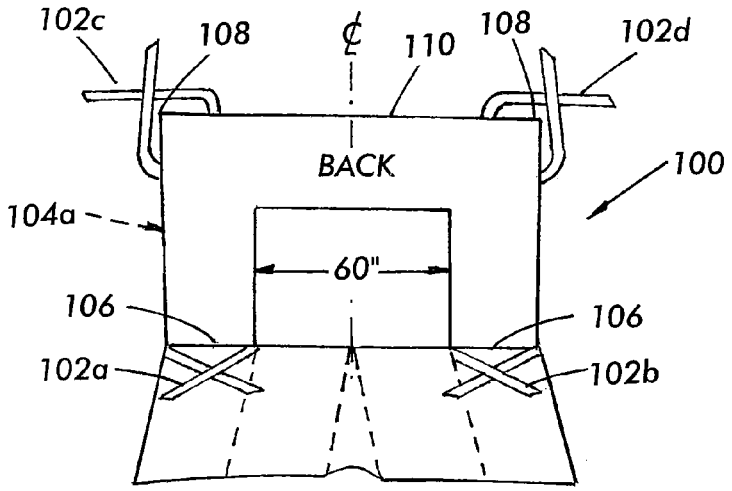
FIG. 1A PRIOR ART
FIG. 1A illustrates a prior art slipcover that includes with ties in predetermined places, and placed over a sofa.
Figure 1B:
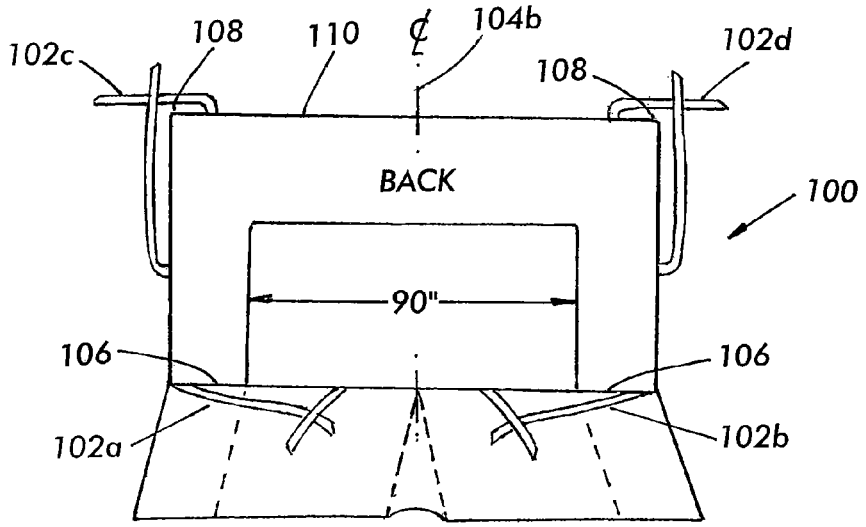
FIG. 1B PRIOR ART
FIG. 1B illustrates the prior art slipcover placed over a sofa which is larger in overall size than the sofa shown in FIG. 1A.
Figure 1C:
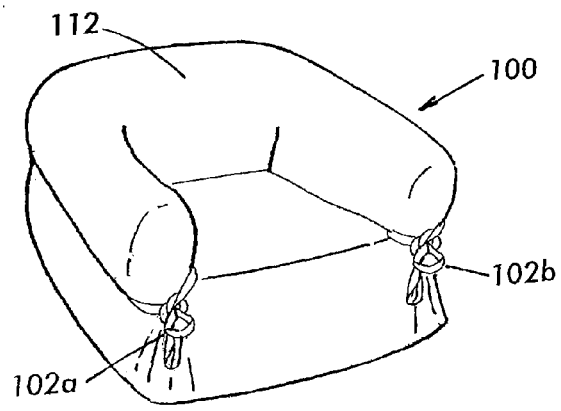
FIG. 1C PRIOR ART
FIG. 1C shows an example prior art slipcover placed over a chair.
Figure 1D:
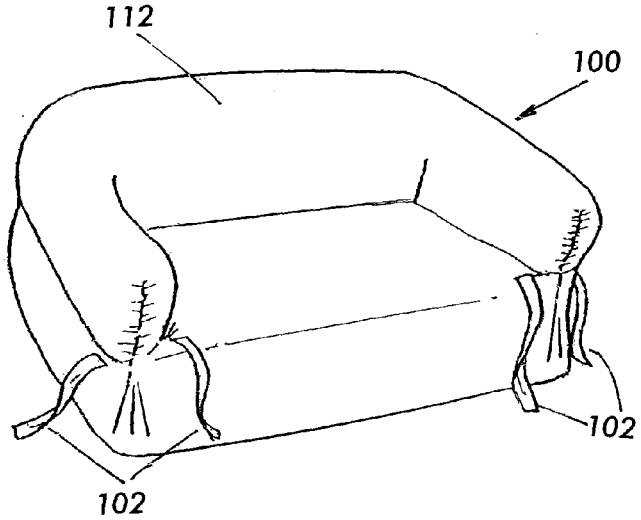
FIG. 1D PRIOR ART
FIG. 1D shows a prior art slipcover covering a sofa with a set of slipcover ties in an untied position.
Figure 1E:
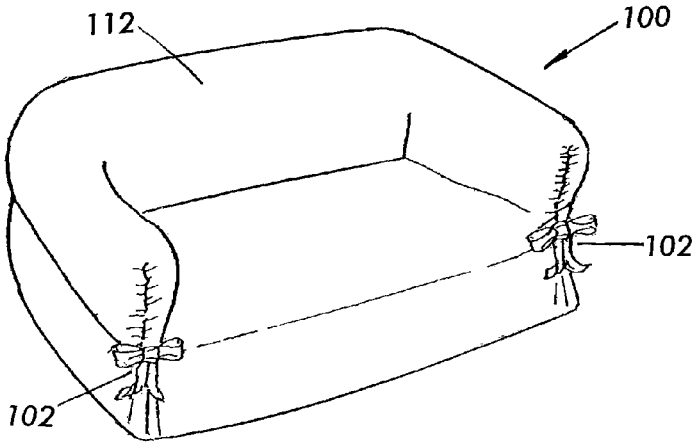
FIG. 1E PRIOR ART
FIG. 1E shows a prior art slipcover covering a sofa with a set of slipcover ties in a tied position.
Figure 2A:
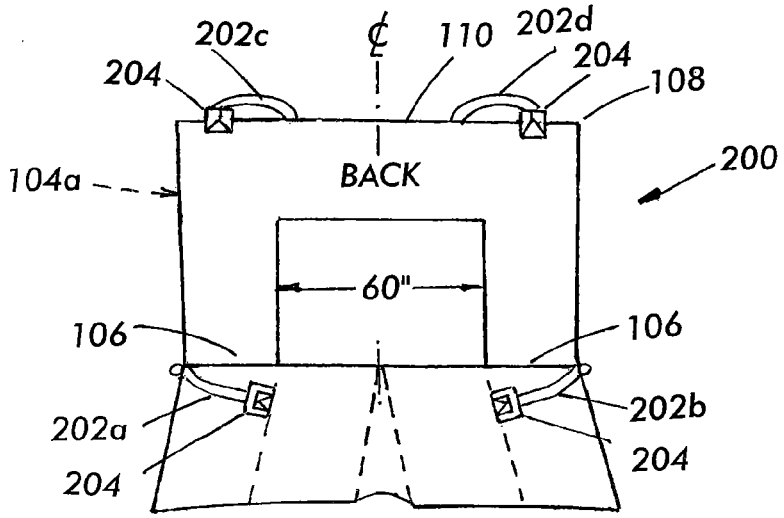
FIG. 2A illustrates an example slipcover provided in accordance with a preferred embodiment of the present invention.

FIG. 2A illustrates an example slipcover 200 provided in accordance with a preferred embodiment of the present invention. In the example shown in FIG. 2A, prior art ties 102 (FIGS. 1A-1E) have been replaced by individual cinching bands or straps 202, which are each provided with a fastening member 204. One skilled in the art will recognize that cinching band 202 can be implemented in a variety of configurations, including made of elastic materials, or in the form of endless elastic bands. Alternatively, cinching band 202 is constructed of a non-elastic, non-stretchable material. As a further alternative, the cinching band is constructed of an elastic band except for a parallel running section which is constructed of a non-elastic, non-stretchable material.

The slipcover 200 illustrated in FIG. 2A comprises a seat cushion pocket portion as well as the main body portion. Once placed over a sofa, chair or other furniture, fabric is tucked in the furniture, for example, under the seat cushion, and the fastening members 204 are fastened to slipcover 200 to provide a neat and snug fit. Although cinching bands 202*c* and 202*d* are shown extending from the top of backrest 110, cinching bands 202*c* and 202*d* are preferably provided behind the backrest 110 of sofa 104*a* such that bands 202*c* and 202*d* and are not visible when viewing sofa 104*a* from the front or sides.

Cinching bands 202*a* and 202*b* are preferably positioned in front of sofa 104*a*, wherein one end of each cinching band 202 is provided at the perimeter of armrests 106. Fastening members 204 coupled to cinching bands 202*a*-202*d* are attached to the fabric of slipcover 200, for example, by clipping fastening member 204 thereto, and securing and fitting slipcover 200 snugly over sofa 104*a*. Excess slipcover material may typically be tucked in between the sofa or chair cushion and the armrests.

When the slipcover is mounted on the sofa or chair, the appearance of the slipcover 200 is changed in that a fold line is defined which consists of the gathered material which is drawn underneath the seat cushion. Separately, there is a line that runs along the front side and possibly around the sofa chair which represents a second elastic band, such as described in U.S. patent application Ser. No. 10/964,436.

As noted above with reference to FIG. 1A, sofa 104*a* illustrated in FIG. 2A has a seat width of 60 inches and a circumference of 200 inches. Cinching bands 204*a* and 204*b*, each comprising fastening member 206, are preferably fastened in front of the slipcover 200 substantially in a center of armrest 106. Cinching bands 204*a* and 204*b* are positioned at the perimeter of armrest 106, and fastened toward the center of sofa 104*a*. Also as shown in FIG. 2A, cinching bands 204*c* and 204*d* may be positioned away from the perimeter of backrest 110, and fastened to the fabric of slipcover 200, via fastening members 204, on portions of the slipcover adapted substantially to cover corners 108 of backrest 110.

Figure 2B:
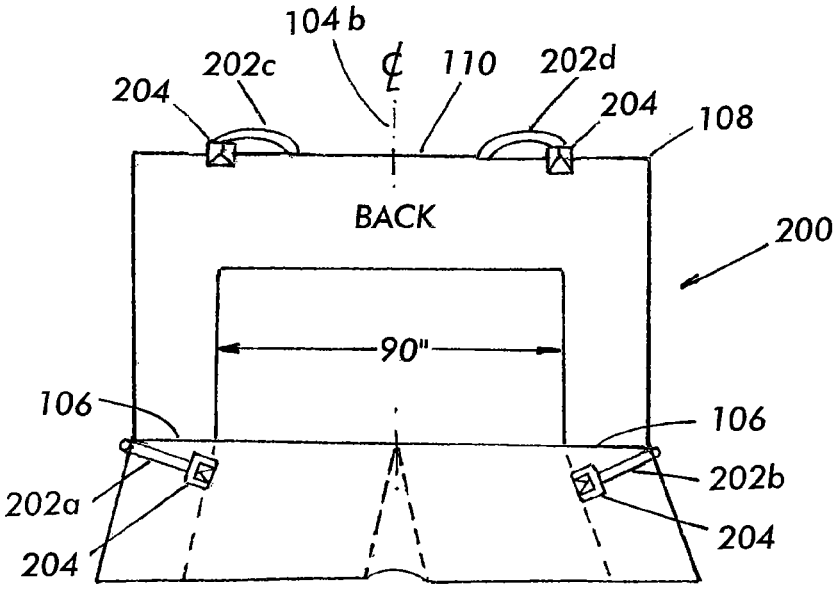
FIG. 2B illustrates the same slipcover placed on the sofa that is larger in size than the sofa shown in FIG. 2A.

FIG. 2B illustrates the same slipcover 200 placed on the larger sofa 104*b* of FIG. 1B. As noted above with reference to FIG. 1B, sofa 104*b* has a seat width of 90 inches and circumference of 260 inches. As shown in FIG. 2B, cinching bands 204*c* and 204*d* are shifted toward the center of backrest 110, and cinching bands 204*a* and 204*b* are positioned in substantially the same location as shown in FIG. 2A: one end is provided at the perimeter of armrests 106 and fastened toward the center of sofa 104*b*. For example, each cinching band, or a fixedly attached end of each cinching band, may be provided on a portion of the slipcover that substantially covers or lies near to a distal lateral edge of the backrest or armrest. In this way, the cinching band may be better anchored to its place because of the tension provided by the furniture to the slipcover at its corner or lateral edge, and thus the cinching band may in turn perform as a stronger securing mechanism. However, it will be understood that the bands may be provided on other portions of the slipcover.

Accordingly, even if the seat of sofa 104*b* is wider than sofa 104*a* by 30 inches, the front appearance or location of fastening members coupled to cinching bands 104*a* and 104*b* are relatively the same. The result is a consistent, substantially identical, and clean front look appearance of slipcover 200 on any virtually seat width.

Thus, as will be recognized by one skilled in the art, the present invention is an improvement over prior art slipcovers 100 because cinching bands 204*a* and 204*b* do not appear shifted on variously-sized furniture. By providing cinching bands 204 with fastening members 206 in place of ties 102, cinching bands 204*a* and 204 appear uniformly positioned on variously sized furniture, thereby resulting in a neat, and consistently well-fitted appearance.

Figure 2C:
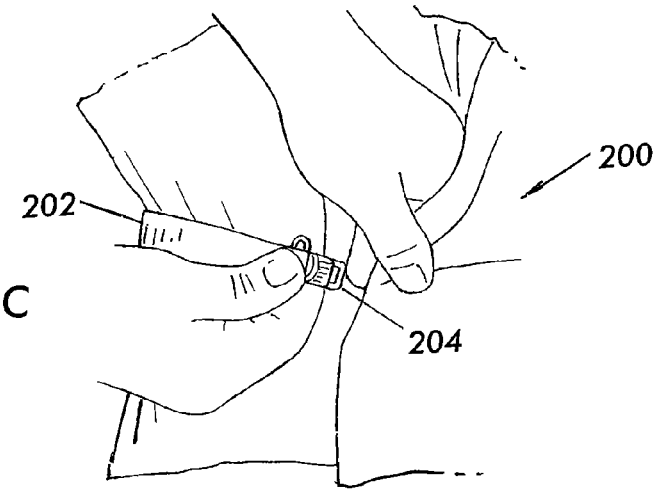
FIG. 2C illustrates the step of placing fastening member to the fabric of a slipcover of the present invention.
Figure 2D:
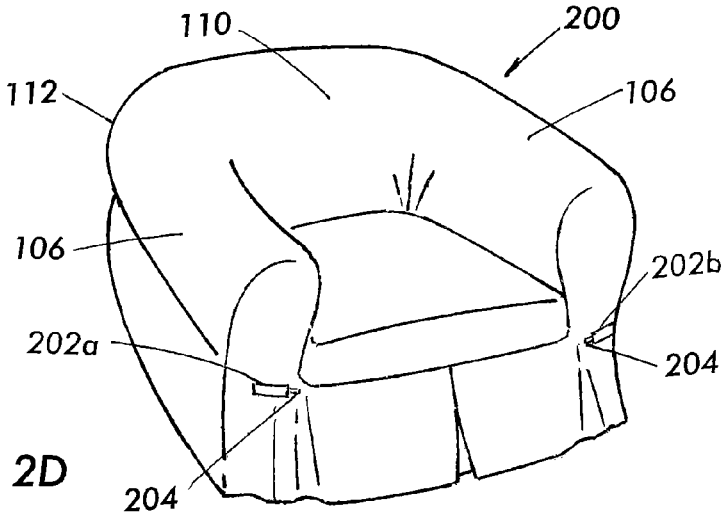
FIG. 2D illustrates fastening members coupled to cinching bands clipped to the fabric of slipcover in accordance with a preferred embodiment.

FIG. 2C illustrates the step of placing fastening member 206 to the fabric of slipcover 200. As shown in FIG. 2C, excess fabric of slipcover 200 is folded in to a pleat and fixed it with a fastening member 206, which in the embodiment shown in FIG. 2C is a clip (e.g., a suspender clip). FIG. 2D illustrates the resulting slipcover 200 neatly placed over sofa 104*b*.

Figure 2E:
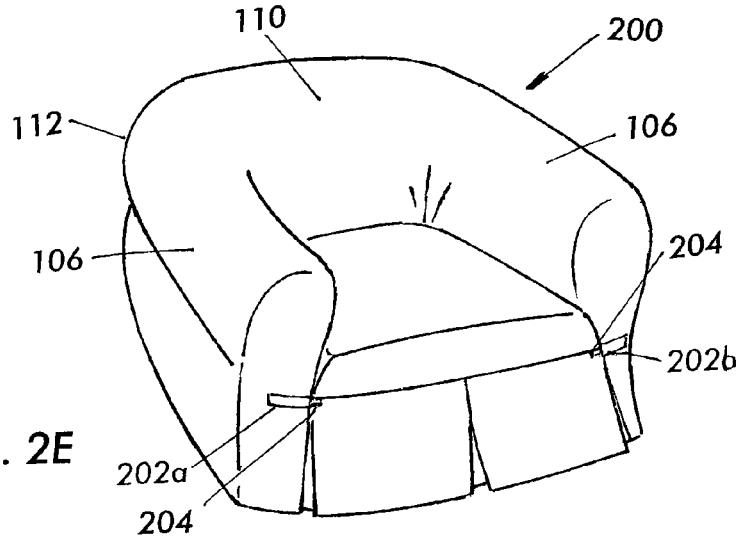
FIG. 2E shows another view of a slipcover placed over chair, and illustrates a cinching band a fastening member attached to a folded pleat of the fabric of slipcover, in accordance with a preferred embodiment.
Figure 2F:
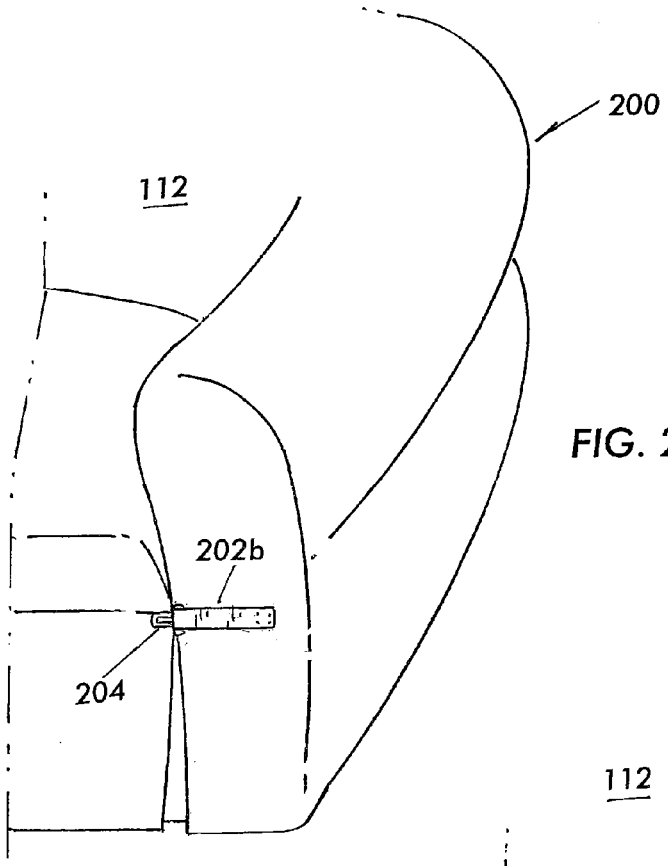
FIG. 2F shows another view of a slipcover placed over a chair in accordance with a preferred embodiment.

FIG. 2D illustrates fastening members 204, coupled to cinching bands 202*a* and 202*b* clipped to the fabric of slipcover 200. As shown in FIG. 2D, slipcover 200 is placed tightly and neatly over a piece of furniture, in this case a chair 112. Also as shown, cinching bands 202*a* and 202*b* are shown extending from the perimeter of armrest 110, and fastened via fastening members 204 toward the center of chair 112. Cinching bands 202*c* and 202*d* (not shown) are positioned behind the chair 112. FIG. 2E is another view of slipcover 200 placed over chair 302, and illustrates cinching band 202*a* and fastening member 204 attached to a folded pleat of the fabric of slipcover 200 in order to provide a neat and snug appearance, which is highly desirable. FIG. 2F shows yet another view of slipcover 200 placed over chair 302, and illustrates cinching band 202*b* and fastening member 204 attached to a folded pleat of the fabric of slipcover 200 in order to provide a neat and snug appearance.

Figure 3:
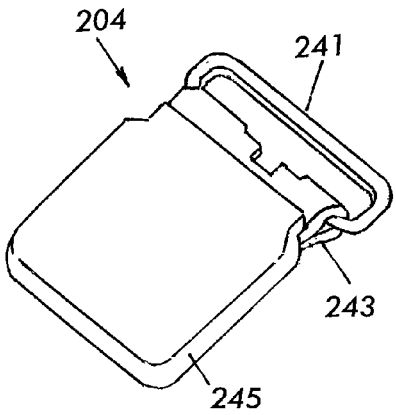
FIG. 3 illustrates a type of suspender clip that may be used as a fastening member in accordance with an aspect of the present invention.

FIG. 3 illustrates a fastening member 204, which is shown as a suspender clip. It will be understood, however, that many other different types of clips may be used as fastening members in accordance the present invention. The illustrated fastening member 204 includes a band-receiving portion 241 into which the cinching band may be threaded. Also, the fastening member 204 includes a clipping portion 245 which includes hinges 243 and may include springs (not shown) or another biasing mechanism to urge the clipping portion 245 to a closing position to secure fabric inside the clipping portion 245. The clipping portion 245 may also include teeth or cleats (not shown) so as more securely to fasten to the fabric, such as the bunched slip cover portion to which the cinching band is secured.

Figure 2G:
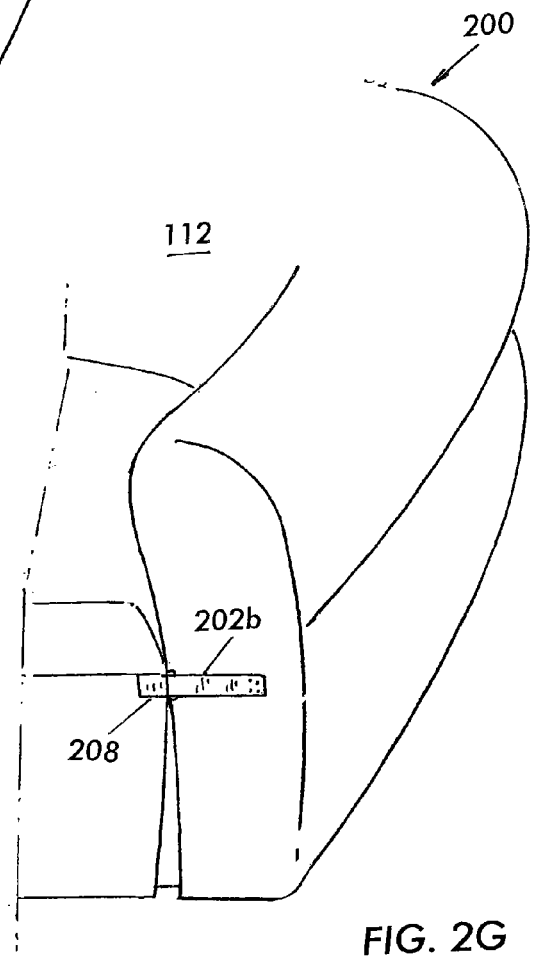
FIG. 2G illustrates an alternative embodiment of slipcover 200, in which the fastening member is concealed by an extended portion of fabric.

FIG. 2G illustrates an alternative embodiment of slipcover 200, in which cinching band 202 includes a length, for example two inches, of fabric 208 which functions to conceal fastening member 204. To some consumers, fastening member 204 is unsightly and blemishes the overall appearance of slipcover 200. According to the alternative embodiment shown in FIG. 2G, fastening member 204 is hidden from view, yet functions in the same way as described above.

Thus, the present invention provides an improvement over prior art slipcovers by ensuring a neat and snug fit of a slipcover over virtually any sized furniture. After slipcover 200 is placed over a piece of furniture, such as a sofa, daybed, bed, chair, loveseat, couch, davenport, or armchair, excess fabric can be tucked under the seat cushion, between the armrest and the seat portions, and/or folded into a pleat to be fastened by fastening member 204. This ensures a neat, snug and well-fit appearance.

Although the present invention has been described in relation to particular embodiments thereof, many other variations, combinations of described features, and modifications and other uses will become apparent to those skilled in the art. It is preferred, therefore, that the present invention be limited not by the specific disclosure herein.

What is claimed is:

1. A furniture slipcover comprising:

a slipcover body adapted to cover at least some surfaces of a piece of furniture that has a front side, a rear side, a left side, and a right side, each side having a longitudinal length, the slipcover body adapted to have a circumferential size that is larger than a combined length of the sides of the piece of furniture;

a first band strip fixedly attached at a first end to the slipcover body and including a fastening member at a second end, the fastening member of the band strip being operative to releasably directly engage, gather and hold a bunched portion of the slipcover body to impart a fitted appearance to the slipcover, and said fastening member being formed as a suspender clip which clip includes a clipping portion which clipping portion is operable to grasp, pull and hold the bunched portion of the slipcover body toward the slipcover body attached to the first end of the band strip, and wherein the first band strip is adapted to extend in a substantially horizontal direction and to be free of substantial dangling, when the fastening member is releasably holding the bunched portion.

2. The slipcover of claim 1, wherein the first band strip comprises an elastic material adapted to exert a contracting force when the fastening member is secured to the bunched portion of the slipcover.

3. The slipcover of claim 1, wherein the first end of the first band strip is located on a first portion of the slipcover adapted to cover an armrest of the piece of furniture.

4. The slipcover of claim 3, wherein the first portion is at a lateral edge of the armrest.

5. The slipcover of claim 1, wherein a first end of a second band strip is located on a second portion of the slipcover adapted to cover a backrest of the piece of furniture.

6. The slipcover of claim 5, wherein the second portion is substantially at a lateral edge of the backrest.

7. The slipcover of claim 5, wherein the first end of the first band strip is located on a first portion of the slipcover adapted to cover an armrest of the piece of furniture, a first end of a third band strip is located on a third portion of the slipcover adapted to cover a second armrest of the piece of furniture, and a first end of a fourth band strip is located on a fourth portion of the slipcover adapted to cover the backrest.

8. The slipcover of claim 7, wherein the first and third portions are disposed to be located substantially at lateral edges of the respective armrests, and the second and fourth portions are disposed to be located substantially at opposite lateral edges of the backrest.

9. The slipcover of claim 1, wherein the first band strip comprises a portion secured to the fastening member.

10. The slipcover of claim 1, wherein the first band strip is comprised of a textile material.

11. The slipcover of claim 1, wherein the first end of the first band strip is disposed to be closer to a lateral edge of the piece of furniture than the fastening member when the fastening member is secured to the bunched portion of the slipcover.

12. The slipcover of claim 1, wherein the first band strip comprises a concealing member made of textile material adapted to conceal the fastening member.

* * * * *